US008757203B2

(12) United States Patent
Cadeau et al.

(10) Patent No.: US 8,757,203 B2
(45) Date of Patent: Jun. 24, 2014

(54) STRUCTURE FOR A GAS VALVE UNIT

(75) Inventors: Christophe Cadeau, Strasbourg (FR); Stéphane Clauss, Stotzheim (FR); Alexander Eisenberg, Detmold (DE); Jörn Naumann, Durbach (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 274 days.

(21) Appl. No.: 13/384,603

(22) PCT Filed: Jul. 15, 2010

(86) PCT No.: PCT/EP2010/060179

§ 371 (c)(1),
(2), (4) Date: Jan. 18, 2012

(87) PCT Pub. No.: WO2011/009794

PCT Pub. Date: Jan. 27, 2011

(65) Prior Publication Data

US 2012/0111434 A1 May 10, 2012

(30) Foreign Application Priority Data

Jul. 24, 2009 (EP) ..... 09290591
Mar. 8, 2010 (EP) ..... 10290114

(51) Int. Cl.
*B67D 1/00* (2006.01)

(52) U.S. Cl.
USPC ..... 137/599.03; 137/599.05; 137/601.01; 137/601.14; 137/862

(58) Field of Classification Search
CPC ..... F23N 1/005; F23N 1/007; F23N 2035/16; F23N 2035/22; F16K 1/00; F16K 31/08; F16K 31/084
USPC ..... 137/599.05, 597, 599.01, 601.01, 137/599.03, 630.16, 602, 601.14, 862; 431/280, 12; 126/52
See application file for complete search history.

(56) References Cited

U.S. PATENT DOCUMENTS 3,334,655 A * 8/1967 Eppendahl ..... 137/596.2
4,168,719 A * 9/1979 Renshaw ..... 137/312

(Continued)

FOREIGN PATENT DOCUMENTS

DE 10249938 A1 5/2004
EP 1640664 A2 * 3/2006
JP 2006010243 A 1/2006

OTHER PUBLICATIONS

Machine Translation of DE10249938 from EPO website, retrieved Dec. 6, 2013.*

(Continued)

*Primary Examiner* — Craig Schneider
*Assistant Examiner* — Jessica Cahill
(74) *Attorney, Agent, or Firm* — James E. Howard; Andre Pallapies

(57) ABSTRACT

A gas valve unit for adjusting a gas volume flow fed to a gas burner of a gas-operated device, particularly a gas cooking appliance, includes a valve body, in which at least two valve seats of open-close valves of the gas valve unit are formed. At least two throttle points each having at least one throttle opening are formed in the valve body. The valve body includes a plurality of mutually parallel plates, with one of the parallel plates forming a valve sealing plate with the at least two valve seats of the open/close valves and another of the parallel plates forming a throttle plate with the throttle openings of the at least two throttle points. The valve sealing plate is made of a flexible material, such as plastic.

20 Claims, 10 Drawing Sheets

(56) References Cited

U.S. PATENT DOCUMENTS

| | | | | |
|---|---|---|---|---|
| 4,947,891 | A * | 8/1990 | Genbauffe | 137/599.17 |
| 4,997,161 | A * | 3/1991 | Hutchison et al. | 251/129.08 |
| 5,027,854 | A * | 7/1991 | Genbauffe | 137/599.17 |
| 5,938,425 | A | 8/1999 | Damrath et al. | |
| 6,609,904 | B2 * | 8/2003 | Chen | 431/71 |
| 7,150,626 | B2 * | 12/2006 | Clauss et al. | 431/6 |
| 7,513,247 | B2 | 4/2009 | Clauss et al. | |
| 2006/0016444 | A1 * | 1/2006 | Clauss et al. | 126/39 E |
| 2006/0057520 | A1 | 3/2006 | Saia et al. | |
| 2013/0059256 | A1 * | 3/2013 | Cadeau et al. | 431/280 |
| 2013/0153065 | A1 * | 6/2013 | Naumann | 137/613 |

OTHER PUBLICATIONS

International Search Report PCT/EP2010/060179, (Mailed Dec. 17, 2010).

* cited by examiner

STRUCTURE FOR A GAS VALVE UNIT

BACKGROUND OF THE INVENTION

The invention relates to a gas valve unit for adjusting a volumetric gas flow supplied to a gas burner of a gas appliance, in particular a gas cooking appliance, wherein the gas valve unit has a valve body in which valve body at least two valve seats of open/close valves of the gas valve unit are embodied, and in which valve body at least two throttle points each having at least one throttle opening are embodied.

Gas valve units of the aforesaid type are described, for example, in the publications EP0818655A2 and WO2004063629A1. By means of gas valve units of this type the volumetric gas flow supplied to a gas burner of a gas cooking appliance can be controlled in a plurality of stages. In this case the volumetric gas flow possesses a reproducible magnitude at each stage. The through-flow cross-section of the gas valve unit overall—and hence the magnitude of the volumetric gas flow—is set by opening or closing specific open/close valves of the gas valve unit and thereby releasing or interrupting the gas flow through specific throttle openings.

The known generic gas valve units are of complex design and are suitable solely for actuation by means of an electronic control unit. With this approach each open/close valve is assigned an electromagnet which is energized and deenergized by the electronic control unit and opens or closes the respective open/close valve.

BRIEF SUMMARY OF THE INVENTION

The object underlying the present invention is to provide a gas valve unit of the type cited in the introduction that is easier to manufacture.

This object is achieved according to the invention in that the valve body has a plurality of plates that are arranged in parallel with one another, wherein a valve sealing plate forms the valve seats of the open/close valves and the throttle openings of the throttle points are arranged in a throttle plate. The valve body comprises a plurality of plates that are layered on top of one another. The plates arranged next to one another are sealed off from one another in such a way that no gas can escape from the joint between two adjacent plates that are directly in contact with each other. Gas ducts are provided in the plates in the form of apertures, such as e.g. boreholes or slots, through which the gas can flow in a direction normal to the plates and in the case of slots also in parallel with the relevant plate. According to the invention one of the plates is implemented as a valve sealing plate which forms the valve seats of the open/close valves. A further plate is implemented as a throttle plate which has throttle openings having a precisely defined cross-section. Said cross-section determines the volumetric gas flow which flows through the throttle point to which the throttle opening belongs when a corresponding open/close valve is open.

A gas tightness of the closed open/close valves is ensured by fabricating the valve sealing plate from a flexible material such as plastic. At the same time the leak tightness of the open/close valve is guaranteed even with low closing forces of the open/close valve.

Each open/close valve has a shut-off body which sits on the sealing plate when the open/close valve is in the closed state. In order to open the open/close valve the shut-off body is lifted off from the valve sealing plate. In the region of each valve seat the valve sealing plate has an orifice which is sealed off by means of the shut-off body sitting on the valve sealing plate when the open/close valve is in the closed state. The orifice forms a channel from the top to the bottom of the valve sealing plate and enables gas to flow through the valve sealing plate when the shut-off body has been lifted off from the valve sealing plate. On the other hand, the shut-off body sitting on the valve sealing plate completely seals the associated orifice.

According to a particularly beneficial embodiment of the invention the shut-off bodies of the open/close valves can be moved by means of the force of at least one permanent magnet. The permanent magnet is preferably part of the gas valve unit and is moved relative to the shut-off bodies manually by an operator for example, or by means of an electric motor. In this case the permanent magnet is preferably moved parallel to the plates of the gas valve unit, i.e. normal to the direction of movement of the shut-off bodies. When the permanent magnet is positioned over a shut-off body, the latter is attracted by the permanent magnet and thus lifted off from the valve sealing plate.

Said open/close valve additionally has a spring by means of which the shut-off body of the open/close valve is pretensioned in the direction of the valve sealing plate. The force of the spring defines a home position of the shut-off body and closes the open/close valve irrespective of the installation position of the gas valve unit. In order to open the open/close valve the shut-off body is lifted off from the valve sealing plate, by means of the magnetic force of the permanent magnet for example, against the force of the spring. The open/close valve can equally be opened by means of direct mechanical coupling, for example by means of a camshaft.

A beneficial development of the invention provides that a pressure plate made from substantially rigid material, for example metal, is arranged on the side of the valve sealing plate facing away from the shut-off bodies. The pressure plate forms a level base for the valve sealing plate and prevents an undesired deformation, for example pressure-induced bending, of the valve sealing plate.

The pressure plate has apertures corresponding to the orifices in the valve sealing plate. The apertures in the pressure plate form a continuation of the orifices in the valve sealing plate.

Preferably the throttle plate is implemented substantially from rigid material, metal for example, preferably from brass or high-grade steel. The throttle openings in the throttle plate have a precisely defined opening cross-section. For this reason an elastic deformability of the throttle plate is undesirable. The use of metal, preferably brass or high-grade steel, allows precise machining of the throttle plate and easy production of the throttle openings.

A first gas distribution plate is particularly advantageously arranged between the pressure plate and the throttle plate, said first gas distribution plate having apertures corresponding to the apertures in the pressure plate and to the throttle openings in the throttle plate. Accordingly, the gas distribution plate enables gas to be ducted through from the apertures in the pressure plate to the associated throttle openings in the throttle plate. At least some of the apertures in the first gas distribution plate additionally connect two adjacent throttle openings of the throttle plate to each other in each case. The apertures in the first gas distribution plate thus enable not only a flow normal to the gas distribution plate but also a flow parallel to the gas distribution plate, with the result that gas can flow across from one throttle opening of the throttle plate to the adjacent throttle opening of the throttle plate.

Additionally arranged on the side of the throttle plate facing away from the first gas distribution plate is a second gas distribution plate which has apertures corresponding to the throttle openings in the throttle plate. Gas can therefore flow across from the throttle openings of the throttle plate into the apertures of the second gas distribution plate.

At least some of the apertures in the second gas distribution plate connect two adjacent throttle openings of the throttle plate to each other in each case. Accordingly, the second gas distribution plate also allows gas to flow across between two adjacent throttle openings of the throttle plate. Toward that end, the apertures in the second gas distribution plate can, just like the apertures in the first gas distribution plate, be embodied as elongated holes.

The arrangement of the apertures in the second gas distribution plate is chosen such that the apertures in the second gas distribution plate in each case connect to each other two adjacent throttle openings of the throttle plate which are not connected by means of the first gas distribution plate. The throttle openings of the throttle plate are therefore connected in series by means of the two gas distribution plates. The gas can flow through each of the throttle openings in succession, the connection between two throttle openings lying next to each other being established by the first gas distribution plate and by the second gas distribution plate in alternation.

Preferably the first gas distribution plate and/or the second gas distribution plate are made from flexible material, from plastic for example. Owing to the use of flexible material the gas distribution plates are reliably sealed off from the throttle plate, so that no gas can escape from the joint between gas distribution plate and throttle plate.

The apertures of the first gas distribution plate can be connected substantially unthrottled to a gas inlet of the gas valve unit by opening the open/close valve assigned to the respective aperture. The open/close valves, the orifices in the valve sealing plate and the apertures in the pressure plate possess no certified throttling function and have a much larger through-flow cross-section compared with the throttle openings.

Precisely one aperture of the second gas distribution plate is connected to a gas outlet of the gas valve unit. Accordingly, the entire gas flow through the gas valve unit flows through at least the last throttle opening of the throttle plate which leads into the aperture of the second gas distribution plate that is connected to the gas outlet. Compared with the other throttle openings, the last throttle opening of the throttle plate can have a particularly large cross-section, such that it possesses no or only a slight throttling effect. Depending on which open/close valve is open, the gas flowing through the gas valve unit flows through the last throttle opening only, through several or through all of the throttle openings of the gas valve unit.

The plates of the valve body of the gas valve unit are superimposed on top of one another in layers. In addition to the above-described plates, further plates may be present which can be embodied for example as sealing plates, as intermediate plates or as pressure plates.

In the assembled state the plates cannot be moved relative to one another. The volumetric gas flow is adjusted solely by moving the shut-off bodies of the open/close valves. The plates cannot be displaced parallel to one another, nor rotated with respect to one another, nor can they be detached from one another during operation.

At least the throttle plate can be replaced in the course of conversion work on the gas valve unit. Replacement of the throttle plate may be necessary for example in order to adapt the gas valve unit to the type of gas being used. Commonly used gas types are natural gas, liquid petroleum gas or town gas. Replacing the throttle plate is also possible if the gas valve unit is to be adapted to a burner having a greater or lesser capacity. The different throttle plates differ from one another in that the various throttle openings have different through-flow cross-sections.

According to an advantageous structural implementation of the gas valve unit the shut-off bodies of the open/close valves and/or the orifices in the valve sealing plate and/or the apertures in the pressure plate and/or the apertures in the first gas distribution plate and/or the throttle openings in the throttle plate and/or the apertures in the second throttle plate are in each case arranged substantially on a circular path. In order to actuate the gas valve unit the permanent magnet is in this case likewise moved on a circular path at a short distance above the shut-off bodies. The permanent magnet can then be arranged for example on a rotary knob.

BRIEF DESCRIPTION OF THE DRAWINGS

Advantageous embodiments and developments of the invention are explained in more detail with reference to the exemplary embodiments depicted in the schematic figures, in which.

DETAILED DESCRIPTION OF EXEMPLARY EMBODIMENTS OF THE PRESENT INVENTION

Figure 1:
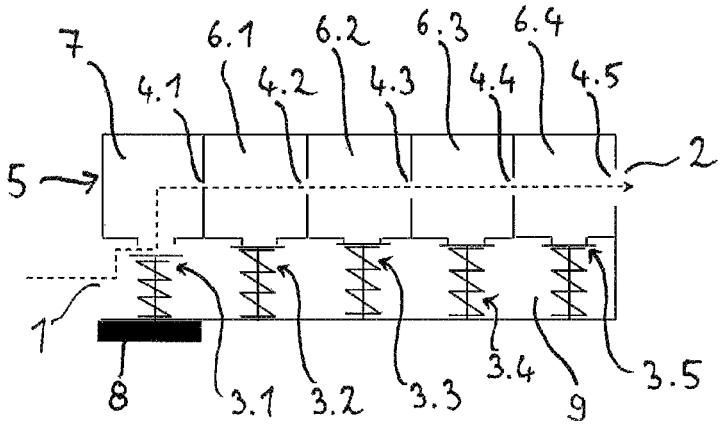
FIG. 1 shows a schematic switching arrangement of the gas valve unit with a first open/close valve open.
Figure 20:
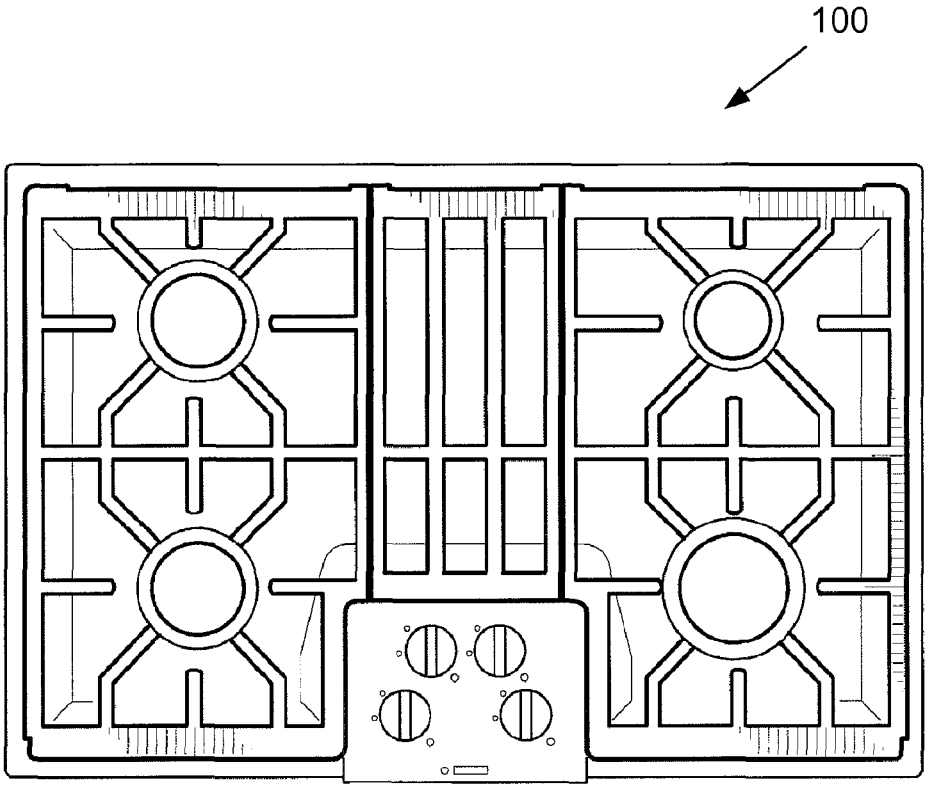
FIG. 20 shows an example of a gas cooking appliance in accordance with embodiments of the invention.

FIG. 1 shows the switching arrangement of the gas valve unit according to the invention. The figure depicts a gas inlet 1 by means of which the gas valve unit is connected for example to a main gas line of a gas cooking appliance. The gas provided for burning is present at the gas inlet 1 at a constant pressure of, for example, 20 millibars or 50 millibars. A gas line leading for example to a gas burner of the gas cooking appliance is connected to a gas outlet 2 of the gas valve unit. The gas inlet 1 is connected by way of a gas inlet chamber 9 of the gas valve unit to the inlet side of the five (in the present exemplary embodiment) open/close valves 3 (3.1 to 3.5). Opening the open/close valves 3 causes the gas inlet 1 to be connected in each case to a specific section of a throttle segment 5 into which the gas flows via the opened open/close valve 3. The throttle segment 5 includes an inlet section 7 into which the first open/close valve 3.1 leads. The further open/close valves 3.2 to 3.5 each lead into a respective connecting section 6 (6.1 to 6.4) of the throttle segment 5. The transition between the inlet section 7 and the first connecting section 6.1, like the transitions between two adjacent sections of the connecting sections 6.1 to 6.4, is formed in each case by a throttle point 4 (4.1 to 4.5). The last throttle point 4.5 connects the last connecting section 6.4 to the gas outlet 2. The throttle points 4.1 to 4.5 possess a sequentially increasing opening cross-section. The through-flow cross-section chosen for the last throttle point 4.5 can be so large that the last throttle point 4.5 possesses practically no throttling function. FIG. 20 shows an example of a gas cooking appliance 100 that includes the switching arrangement of the gas valve unit according to the invention.

The open/close valves 3 are actuated by means of a permanent magnet 8 which is movable along the row of open/close valves 3. In this arrangement the force required for opening the respective open/close valve 3 is created directly by the magnetic force of the permanent magnet 8. Said magnetic force opens the respective open/close valve 3 against a spring force.

Only the first open/close valve 3.1 is open in the switching position according to FIG. 1. The gas flows from the gas inlet chamber 9 through said open/close valve 3.1 into the inlet section 7 and from there passes all throttle points 4 and all connecting sections 6 on the way to the gas outlet 2. The volume of gas flowing through the valve unit dictates the minimum performance of the gas burner connected to the gas valve unit.

Figure 2:
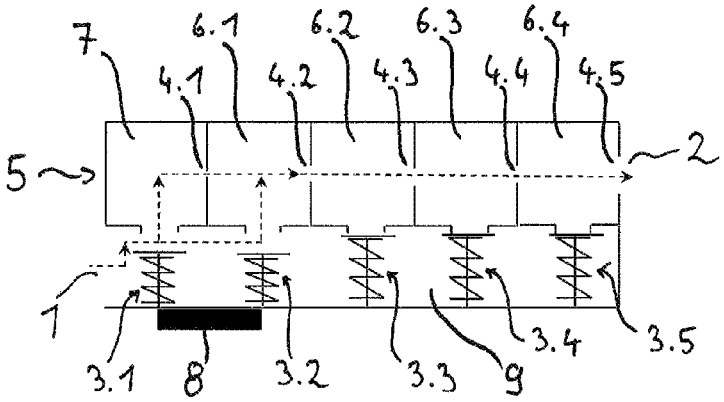
FIG. 2 shows the schematic switching arrangement with two open/close valves open.

FIG. 2 shows the schematic switching arrangement in which the permanent magnet 8 is moved to the right in the drawing such that both the first open/close valve 3.1 and the second open/close valve 3.2 are open.

The gas flows from the gas inlet chamber 9 through the open second open/close valve 3.2 directly into the first connecting section 6.1 and from there via the throttle points 4.2 to 4.5 to the gas outlet 2. Because the open/close valve 3.2 is open the gas flowing to the gas outlet 2 bypasses the first throttle point 4.1. The volumetric gas flow in the switching position according to FIG. 2 is therefore greater than the volumetric gas flow in the switching position according to FIG. 1. The gas inflow into the first connecting section 6.1 takes place practically exclusively via the second open/close valve 3.2. Owing to the open/close valves 3.1 and 3.2 remaining in the open state the same pressure level prevails in the inlet section 7 as in the first connecting section 6.1. For this reason virtually no further gas flows out of the inlet section 7 via the first throttle point 4.1 into the first connecting section 6.1. There is therefore practically no change in the volumetric gas flow flowing overall through the gas valve unit when the permanent magnet 8 is moved further to the right in the drawing and as a result the first open/close valve 3.1 is closed while the second open/close valve 3.2 is open.

By the permanent magnet 8 being moved to the right in the drawing the open/close valves 3.3 to 3.5 are opened in succession and the volumetric gas flow through the gas valve unit is thereby increased step by step.

Figure 3:
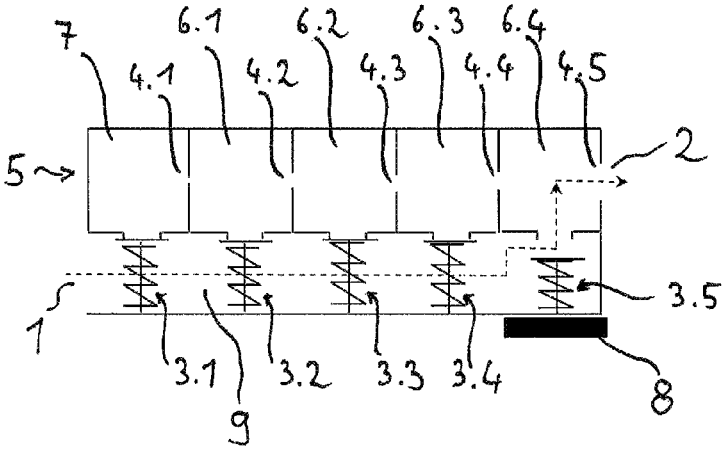
FIG. 3 shows the schematic switching arrangement with the last open/close valve open.

FIG. 3 shows the schematic switching arrangement of the gas valve unit in the maximum open position. In this case the permanent magnet 8 is located at its end position on the right-hand side in the drawing. In this position of the permanent magnet 8 the last open/close valve 3.5 is open. In this case gas flows directly from the gas inlet chamber 9 into the last connecting section 6.4 and passes only the last throttle point 4.5 on the way to the gas outlet 2. Said last throttle point 4.5 can have a through-flow cross-section that is so great that practically no throttling of the gas flow occurs and the gas can flow practically without restriction through the gas valve unit.

FIGS. 4 to 8 schematically show a constructional layout of a gas valve unit having a switching arrangement according to FIGS. 1 to 3. A valve body 20 can be seen in which the gas inlet 1 of the gas valve unit is embodied. Located in the interior of the valve body 20 is a gas inlet chamber 9 connected to the gas inlet 1. Shut-off bodies 10 of the open/close valves 3 are guided in the valve body 20 in such a way that they can move upward and downward as shown in the drawing. Each shut-off body 10 is pretensioned downward as shown in the drawing by means of a spring 11. Each shut-off body 10 can be moved upward as shown in the drawing against the force of the spring 11 by means of the force of the permanent magnet 8. The springs 11 press the shut-off bodies onto a valve sealing plate 12 so that the shut-off bodies 10 seal the orifices **12*a* present in the valve sealing plate 12 in a gas-tight manner. Arranged below the valve sealing plate 12 is a pressure plate 13 having apertures 13*a* corresponding to the orifices 12*a* in the valve sealing plate 12. The apertures 13*a* in the pressure plate 13 lead into apertures 14*a* in a first gas distribution plate 14. According to the drawing, a throttle plate 15 having a plurality of throttle openings 18 is located below the first gas distribution plate 14. In this arrangement each of the throttle points 4.1 to 4.4 is formed by two throttle openings 18. The two throttle openings 18 belonging to one throttle point 4.1 to 4.4 are in each case connected to each other by means of the apertures 16*a* in a second gas distribution plate 16. The apertures 14*a* in the first gas distribution plate, on the other hand, connect the adjacently located throttle openings 18 of two adjacent throttle points 4.1 to 4.5. The last throttle point 4.5 consists of just one throttle opening 18 which leads via a corresponding aperture 16*a* in the second gas distribution plate 16 into the gas outlet 2** of the gas valve unit.

Figure 4:
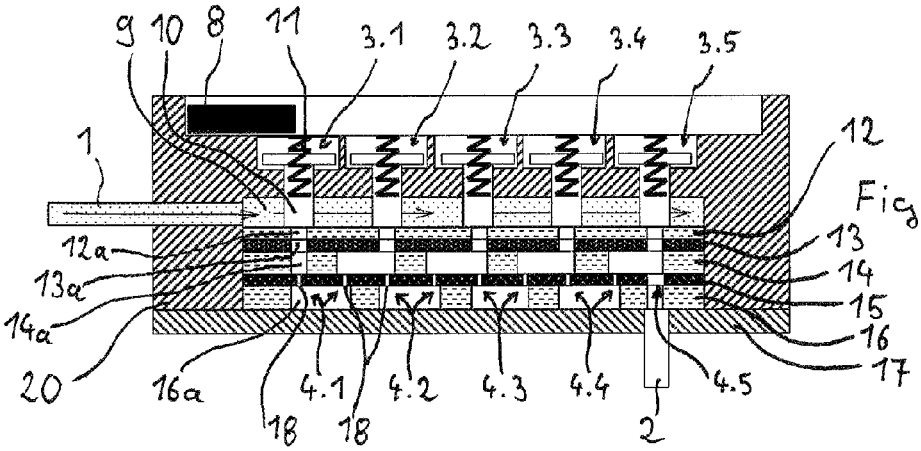
FIG. 4 shows the schematic structure of the gas valve arrangement with open/close valves closed.

In the switching position according to FIG. 4 the permanent magnet 8 is located at an end position in which all of the open/close valves 3 are closed. The gas valve unit as a whole is therefore closed. The volumetric gas flow is equal to zero.

Figure 5:
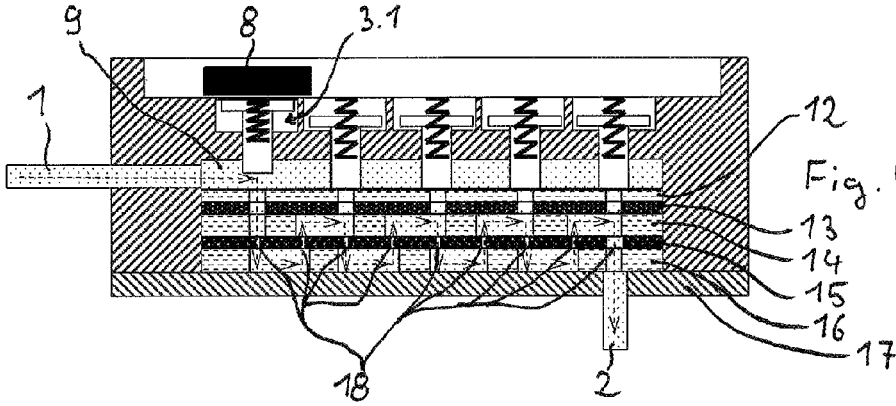
FIG. 5 shows the schematic structure with one open/close valve open.

FIG. 5 shows the schematic structure of the gas valve unit with the first open/close valve 3.1 open. The gas flows from the gas inlet 1 into the gas inlet chamber 9 and from there via the first aperture in each case of the valve sealing plate 12, the pressure plate 13 and the first gas distribution plate 14 to the throttle plate 15. On the way to the gas outlet 2 the gas flows through all the throttle openings 18 of the throttle plate 15 as well as through all the apertures **14*a* of the first gas distribution plate 14 and all the apertures 16*a* of the second gas distribution plate 16**.

Figure 6:
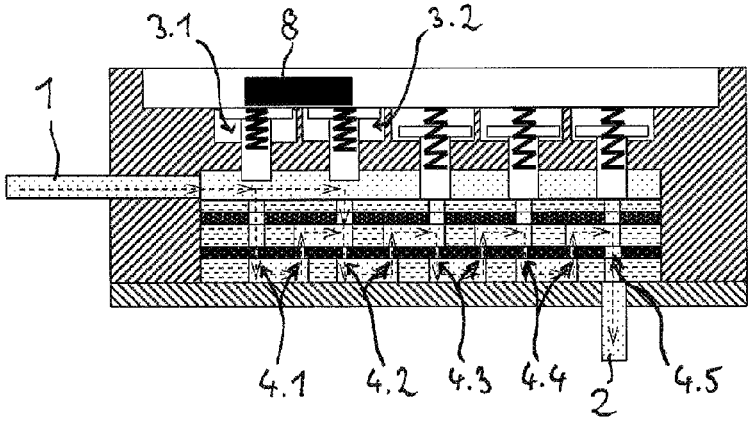
FIG. 6 shows the schematic structure with the first two open/close valves open.

FIG. 6 shows the schematic structure with both first open/close valve 3.1 and second open/close valve 3.2 open. Because the second open/close valve 3.2 is open the throttle openings 18 of the first throttle point 4.1 are bypassed, with the result that the gas goes directly to the second throttle point 4.2 and flows through the further throttle points 4.3 to 4.5 on the way to the gas outlet 2. Because the first open/close valve 3.1 is open the gas path via the first throttle point 4.1 is open. Practically no gas flows through the first throttle point 4.1 owing to the same pressure level prevailing on both sides of the first throttle point 4.1.

Figure 7:
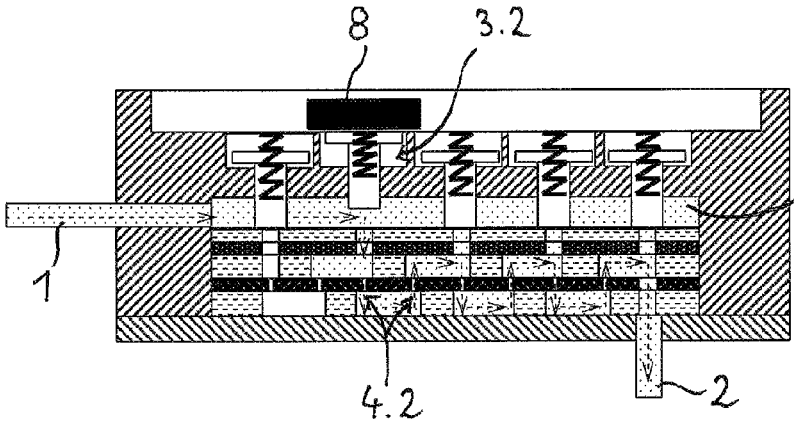
FIG. 7 shows the schematic structure with the open/close valve open.

FIG. 7 shows the schematic structure with the second open/close valve 3.2 open. All the other open/close valves 3.1 and 3.3 to 3.5 are closed. The volumetric gas flow through the gas valve unit is practically identical to the volumetric gas flow in the valve position according to FIG. 6.

The permanent magnet 8 and the components of the open/close valves 3 are coordinated with one another in such a way that when the gas valve unit is open either precisely one open/close valve 3 is open or precisely two open/close valves 3 are open. During the switchover from one open/close valve 3 to an adjacent open/close valve 3, both adjacent open/close valves 3 are always open together briefly. This ensures that a switchover does not lead to a temporary interruption of the gas supply to a gas burner and consequently to flickering or extinction of the gas flames. By means of the above-described switch it is also ensured that no momentary increase in the volumetric gas flow occurs during a switchover operation. Flaring up of the gas flames during a switchover operation is also reliably prevented in this way.

Figure 8:
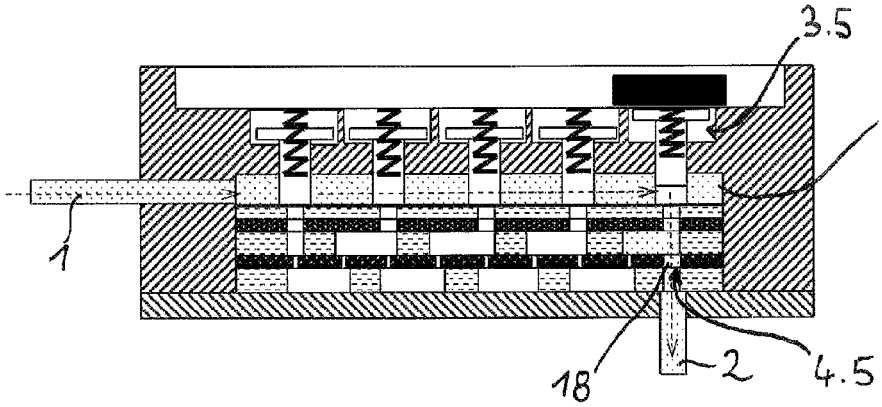
FIG. 8 shows the schematic structure with the last open/close valve open.

FIG. 8, finally, shows the schematic structure of the gas valve unit when only the last open/close valve 3.5 is open. In this case the gas flows from the gas inlet via the gas inlet chamber, the opened open/close valve 3.5 and the last throttle opening 18 associated therewith practically without obstruction to the gas outlet.

Figure 9:
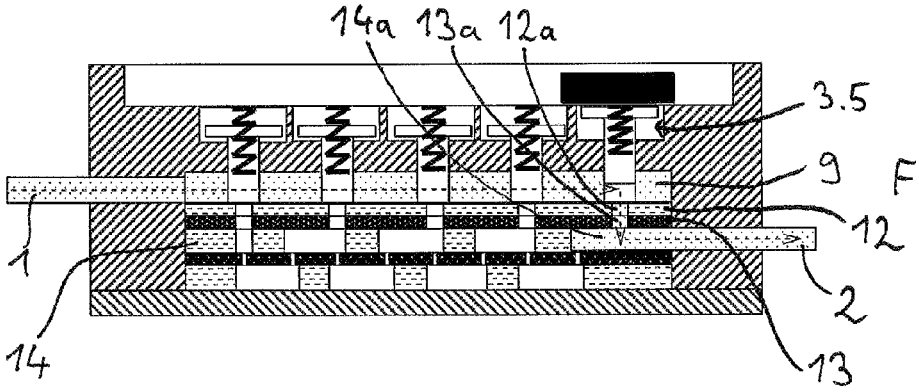
FIG. 9 shows the schematic structure of a variant of the gas valve unit.

FIG. 9 shows the schematic structure of a variant of the gas valve unit. In contrast to the embodiment according to FIGS. 4 to 8, in this case the gas outlet 2 branches off directly from the first gas distribution plate 14. With open/close valve 3.5 open, the gas flows unthrottled via the gas inlet 1, the gas inlet chamber 9, the open/close valve 3.5, the last orifice 12*a* in the valve sealing plate 12, the last aperture 13*a* in the pressure plate 13 and the last aperture 14*a* in the first gas distribution plate 14 to the gas outlet 2. The last throttle point 4.5 (see FIGS. 4 to 8) is not present in the variant according to FIG. 9.

Figure 10:
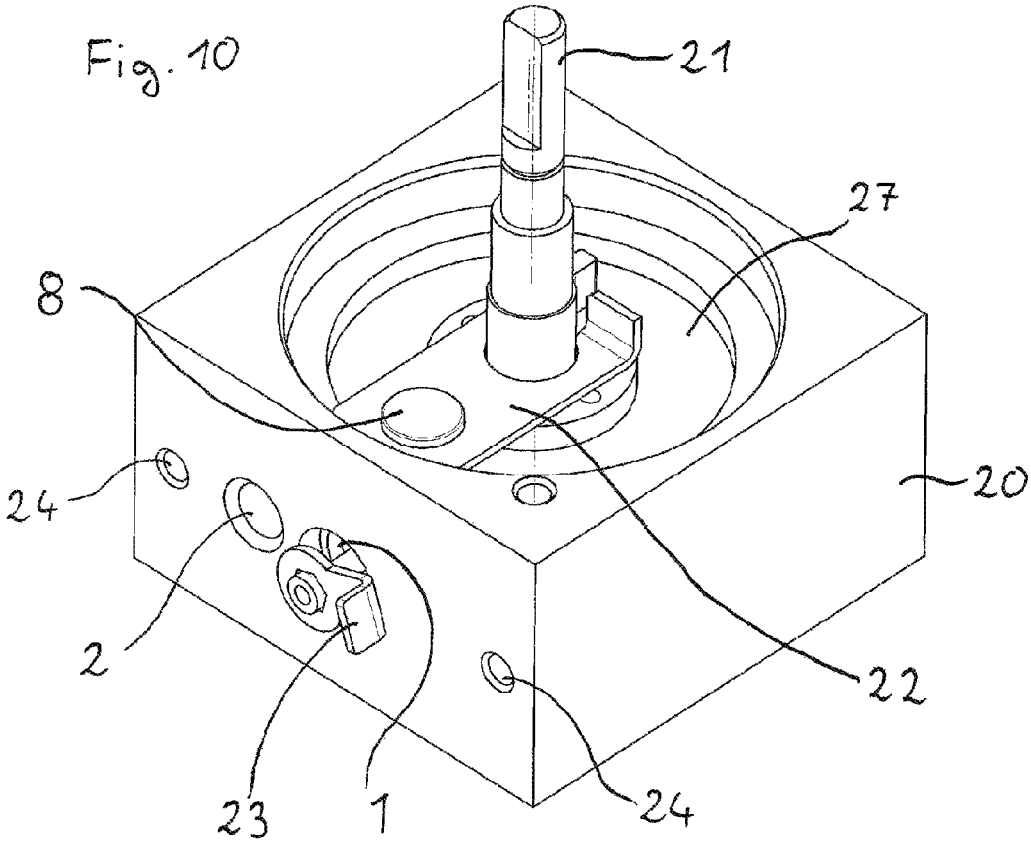
FIG. 10 shows the gas valve unit in a perspective view obliquely from above.

FIG. 10 shows an exemplary embodiment of the gas valve unit in a perspective view obliquely from above. Clearly to be seen in the figure is a valve body 20 in which a switching shaft 21 of the gas valve unit is rotatably mounted. Coupled to the switching shaft 21 is a driver 22 which transmits a rotary movement of the switching shaft 21 to a permanent magnet 8 which is thereby guided on a circular path during a rotary movement of the switching shaft 21. A cover 27 forms a sliding surface for the permanent magnet 8 and establishes a defined clearance between the permanent magnet 8 and the open/close valves 3. Also evident is the gas outlet 2 and an actuating lever 23 arranged in the gas inlet 1 for a solenoid valve unit (not shown). The actuating lever 23 is coupled to the switching shaft in such a way that when the switching shaft is subjected to axial pressure the actuating lever 23 travels out of the valve body 20. Accordingly, the solenoid valve unit can be opened by pressing the switching shaft 21. Boreholes 24 serve for securing the solenoid valve unit to the valve body.

Figure 11:
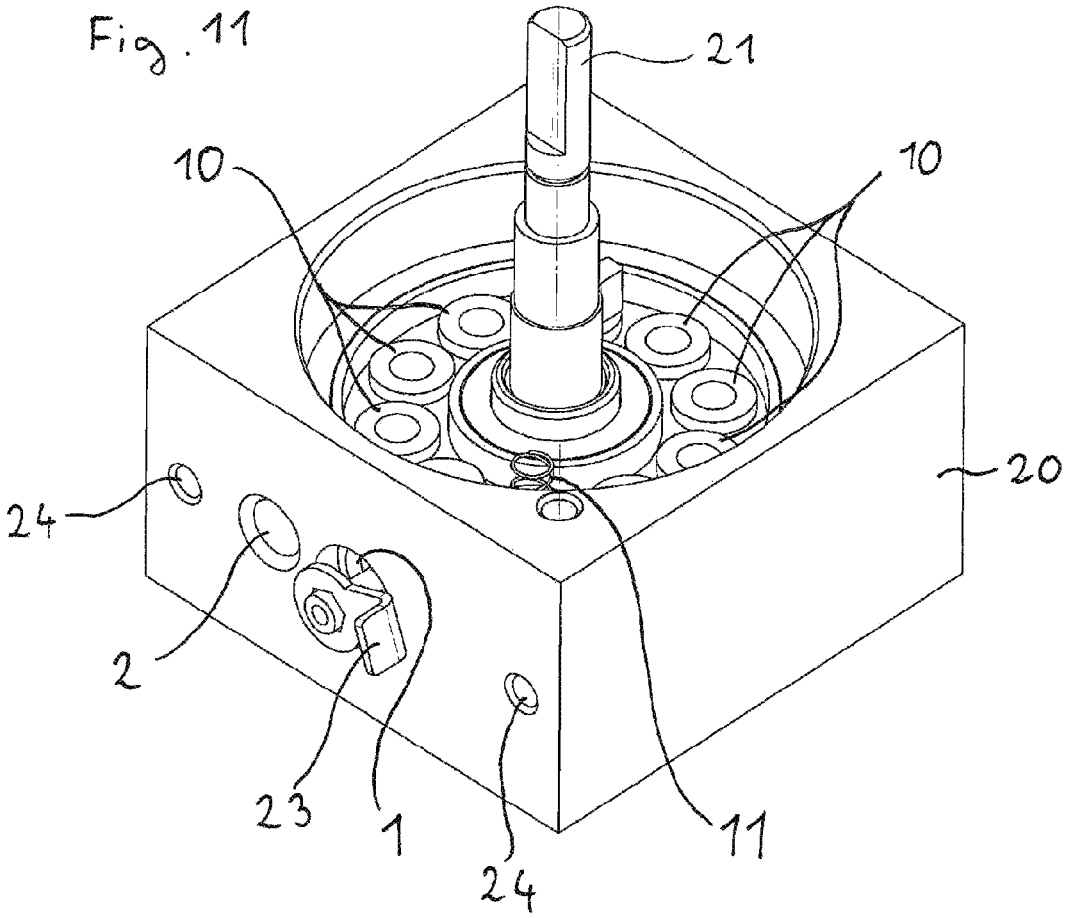
FIG. 11 shows the perspective view looking onto the open/close valves.

FIG. 11 shows the view according to FIG. 10 with the driver 22 and the permanent magnet 8 omitted. Clearly to be seen in FIG. 11 are in particular the annularly arranged shut-off bodies 10 of the open/close valves 3. Each of the shut-off bodies 10 is assigned a spring 11 which presses the shut-off body 10 downward in the drawing. One of the springs 11 is shown in FIG. 11 by way of example.

Figure 12:
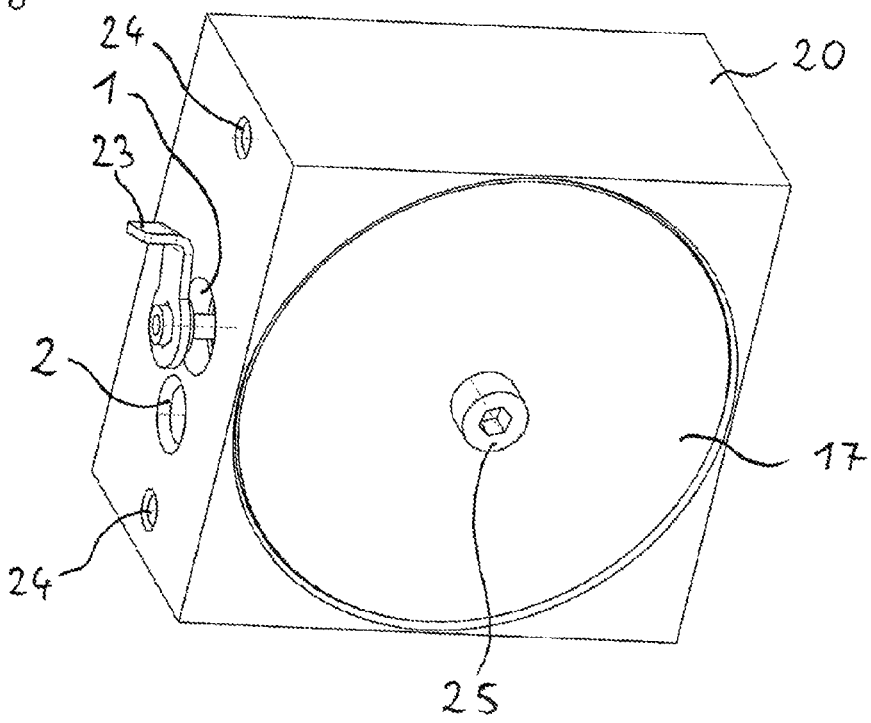
FIG. 12 shows the gas valve unit in a perspective view obliquely from below.

FIG. 12 shows the gas valve unit in a perspective view obliquely from below. Evident here in particular is a closing plate 17 which presses together the remaining plates not shown in the figure, the valve sealing plate 12, the pressure plate 13, the first gas distribution plate 14, the throttle plate 15 and the second gas distribution plate 16. The force required for this is generated by means of a bolt 25.

Figure 13:
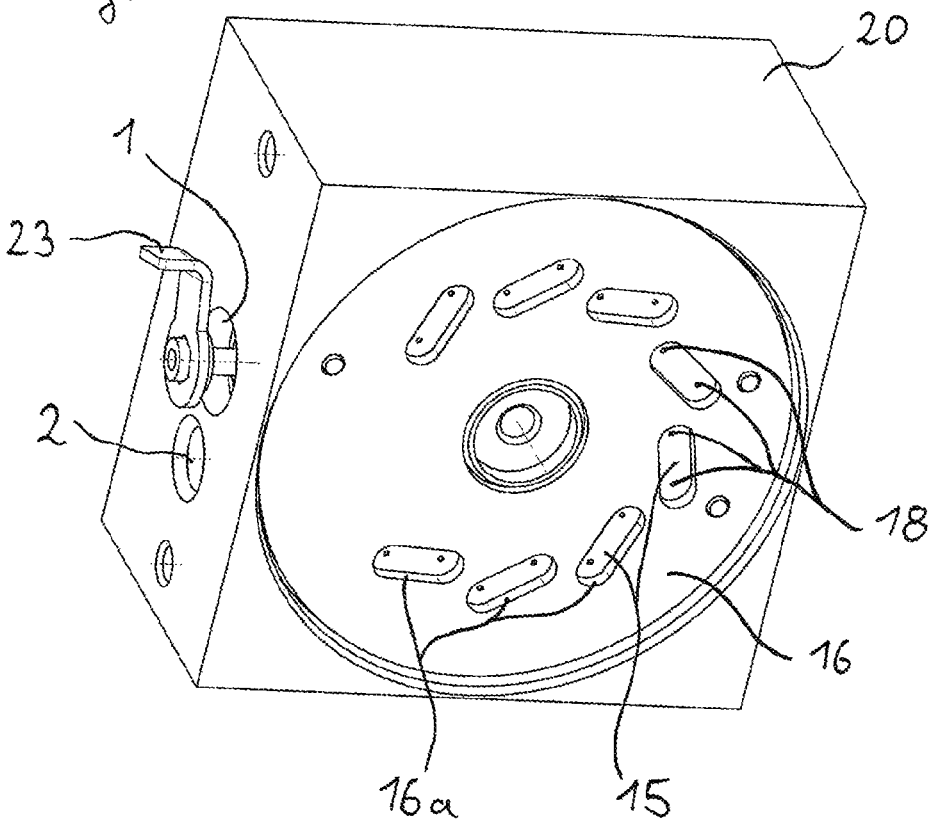
FIG. 13 shows the perspective view looking onto a lower gas distribution plate.

FIG. 13 shows the view according to FIG. 12 with closing plate 17 removed. Evident here is the second gas distribution plate 16 having the apertures 16*a*. Sections of the throttle plate 15 with the throttle openings 18 contained therein can be seen through said apertures 16*a*. It can also be seen that two throttle openings 18 in each case are connected via an aperture 16*a* of the second gas distribution plate 16.

Figure 14:
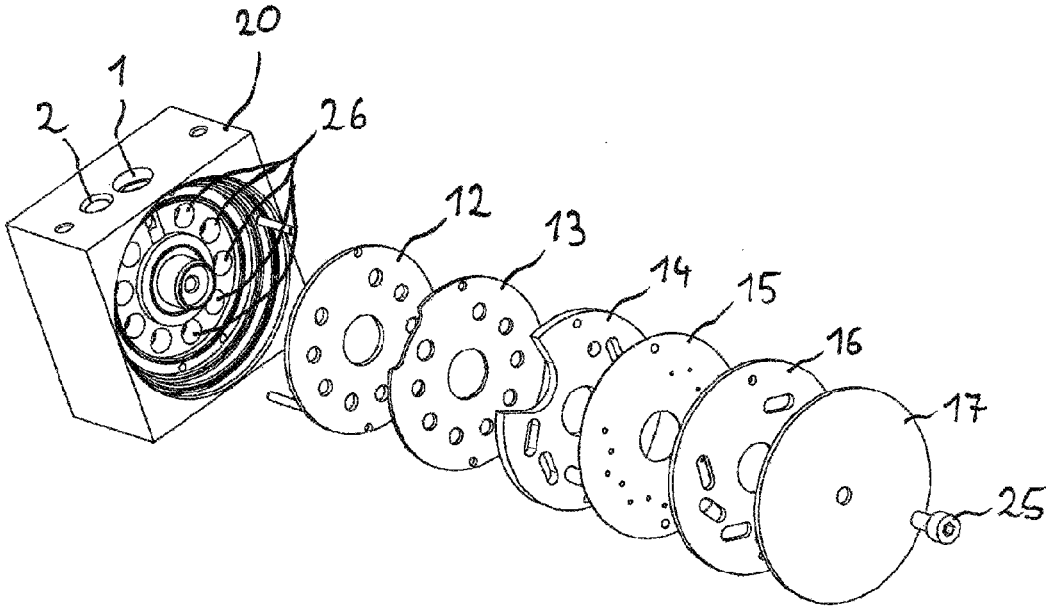
FIG. 14 is an exploded view of the gas valve unit, looking obliquely from below.

The layer-by-layer structure of the gas valve unit is illustrated with the aid of FIG. 14 in an exploded view. Evident here is the valve body 20 with guide boreholes 26 for the shut-off bodies 10 (not shown in the present view) of the open/close valves 3. The below-cited plates are inserted into the valve body 20 in the following order: valve sealing plate 12, pressure plate 13, first gas distribution plate 14, throttle plate 15, second gas distribution plate 16, closing plate 17. The bolt 25 presses the plates 12, 13, 14, 15, 16, 17 supported on the valve body 20 onto one another.

In the present exemplary embodiment the plates 12, 13, 14, 15, 16, 17 are inserted individually into the valve body 20. It is, however, also possible to prefabricate the plates 12, 13, 14, 15, 16, 17 as a package so that they can only be inserted into the valve body 20 and removed again all together. In order to convert the gas valve unit to another type of gas it will then be necessary, depending on the design, to replace either just the throttle plate 15 or the entire package composed of the plates 12, 13, 14, 15, 16, 17.

Figure 15:
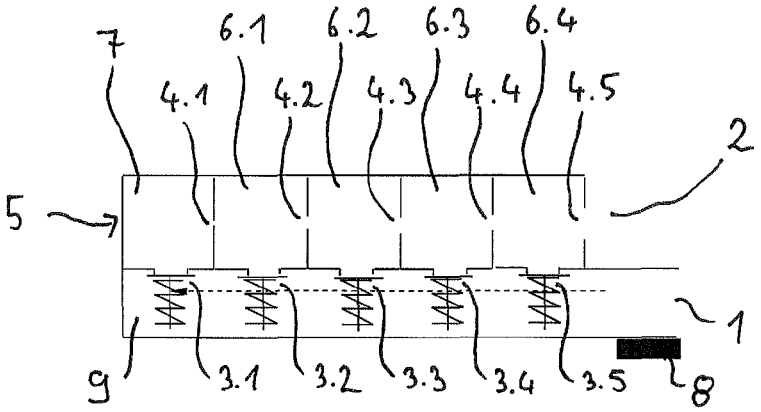
FIG. 15 shows a variant of the switching arrangement according to FIGS. 1-3 in the fully closed state.

FIG. 15 shows a variant of the switching arrangement according to FIGS. 1 to 3. The arrangement of the throttle segment 5 with the throttle points 4 (4.1 to 4.5) corresponds exactly to the arrangement according to FIGS. 1 to 3. The arrangement of the gas inlet chamber 9, as well as of the open/close valves 3 (3.1 to 3.5), also corresponds to the exemplary embodiment according to FIGS. 1 to 3. In contrast to the exemplary embodiment according to FIGS. 1 to 3 the gas inlet 1 is located on the right-hand side of the gas inlet chamber 9 in the drawing. However, the location of the gas inlet 1 in relation to the gas inlet chamber 9 and hence also the flow direction of the gas inside the gas inlet chamber 9 are largely immaterial for the functioning of the gas valve unit. Within the throttle segment 5 the gas flows, analogously to the arrangement according to FIGS. 1 to 3, in the left-to-right direction. Accordingly, the throttle point 4.1 on the left in the drawing is designated as the first throttle point. The throttle point 4.5 on the right in the drawing is designated as the last throttle point. Observing this nomenclature, the open/close valve 3.1 on the left in the drawing will be referred to in the following—as also in the exemplary embodiment according to FIGS. 1 to 3—as the first open/close valve and the open/close valve 3.5 on the right in the drawing as the last open/close valve.

In the switching position shown in FIG. 15 the permanent magnet 8 is located to the right of the last open/close valve 3.5. The permanent magnet 8 therefore exerts a magnetic force on none of the open/close valves 3, which consequently means that none of the open/close valves 3.1 to 3.5 is open. Thus, the gas valve unit is fully closed and the connection between gas inlet 1 and gas outlet 2 is completely blocked.

In order to open the gas valve unit starting from this switching position, the permanent magnet 8 is shifted to the left into the region of the last open/close valve 3.5.

Figure 16:
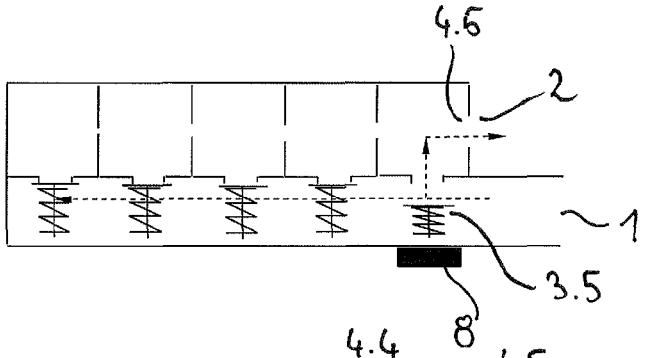
FIG. 16 shows the variant of the switching arrangement in the fully open state with one open/close valve open.

This switching position, in which the gas valve unit is open at a maximum, is shown in FIG. 16. In this case the gas flows from the gas inlet 1 via the opened last open/close valve 3.5 and the last throttle point 4.5 directly to the gas outlet 2. The last throttle point 4.5 can have an opening cross-section that is so great that practically no throttling of the gas flow takes place. In this case the gas flow passes practically unobstructed through the gas valve unit.

Figure 17:
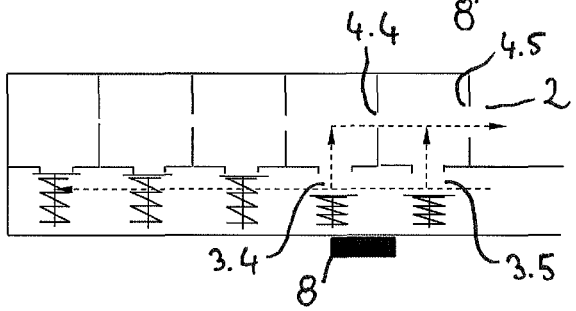
FIG. 17 shows the variant of the switching arrangement in the fully open state with two open/close valves open.

As a result of the permanent magnet 8 being moved to the left in the drawing, the gas flow through the gas valve unit can now be throttled in stages. FIG. 17 shows an intermediate position of the permanent magnet 8 in which the latter opens both open/close valves 3.4 and 3.5. In this case, however, the volumetric gas flow to the gas outlet 2 is practically identical to the volumetric gas flow in the switching position according to FIG. 16.

Figure 18:
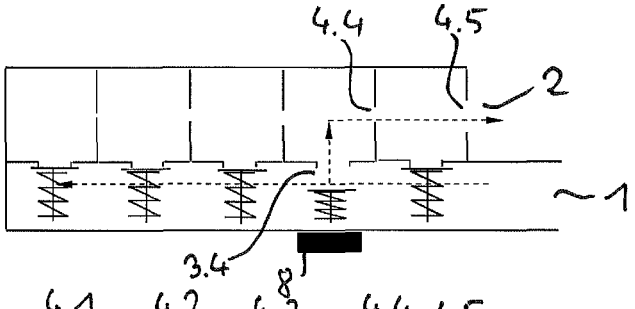
FIG. 18 shows the variant of the switching arrangement in the partially open state.

In the switching position according to FIG. 18 the permanent magnet opens only the open/close valve 3.4. On the way to the gas outlet 2 the gas flow leads both through the throttle point 4.4 and through the throttle point 4.5. The opening cross-section of the throttle point 4.4 is smaller than the opening cross-section of the throttle point 4.5, with the result that the gas flow is somewhat throttled.

Figure 19:
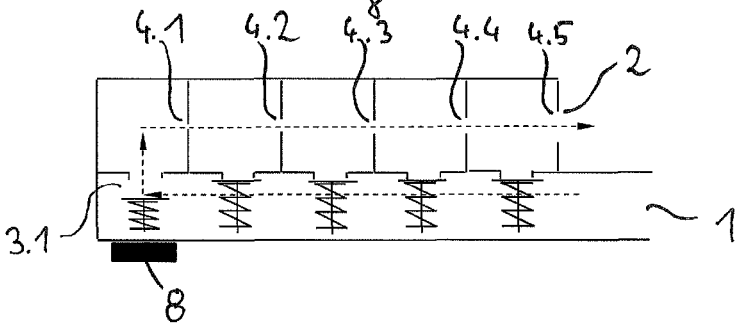
FIG. 19 shows the variant of the switching arrangement in the minimum open state.

FIG. 19 shows the gas valve unit in the minimum opening position, in which only the open/close valve 3.1 is open. On the way to the gas outlet 2 the gas flows through all of the throttle points 4.1 to 4.5. Viewed in the gas flow direction in the throttle segment 5, the throttle points 4 possess an increasing cross-section. Accordingly, the volumetric gas flow becoming established is mainly determined by the throttle point 4.1, which possesses the smallest opening cross-section. The flow resistance caused by the remaining throttle points 4.2 to 4.5 and likewise influencing the volumetric gas flow is taken into account in the dimensioning of the opening cross-sections.

In the switching arrangement according to FIGS. 15 to 19 the gas valve unit is located immediately in its maximum open position when it is actuated starting from its closed position. This has the positive effect that the gas-conducting lines and gas burners disposed downstream of the gas valve unit fill particularly quickly with gas. Furthermore, the gas burner can be ignited immediately after the opening of the gas valve unit at maximum volumetric gas flow, thereby facilitating the ignition process.

LIST OF REFERENCE SIGNS

1 Gas inlet
2 Gas outlet
3 (3.1 to 3.5) Open/close valves
4 (4.1 to 4.5) Throttle points
5 Throttle segment
6 (6.1 to 6.4) Connecting section
7 Inlet section
8 Permanent magnet
9 Gas inlet chamber
10 Shut-off body
11 Spring
12 Valve sealing plate
12*a* Orifices
13 Pressure plate
13*a* Apertures
14 First gas distribution plate
14*a* Apertures
15 Throttle plate
16 Second gas distribution plate
16*a* Apertures
17 Closing plate
18 Throttle openings
20 Valve body
21 Switching shaft
22 Driver
23 Actuating lever
24 Boreholes
25 Bolt
26 Guide boreholes
27 Cover

The invention claimed is:

1. A gas valve unit for adjusting a volumetric gas flow supplied to a gas burner of a gas appliance, said gas valve unit comprising:

a plurality of open/close valves, a valve body comprising a plurality of mutually parallel plates and at least two valve seats of the open/close valves, and at least two throttle points, with each of the at least two throttle points having at least one throttle opening, wherein one of the parallel plates forms a valve sealing plate with the at least two valve seats of the open/close valves and another of the parallel plates forms a throttle plate with the throttle openings of the at least two throttle points, and the throttle openings are fixed open.

2. The gas valve unit of claim 1, wherein the gas appliance is a gas cooking appliance.

3. The gas valve unit of claim 1, wherein the valve sealing plate is made from a flexible material.

4. The gas valve unit of claim 3, wherein the valve sealing plate is made from plastic.

5. The gas valve unit of claim 1, wherein each open/close valve has a shut-off body seated on the valve sealing plate when the open/close valve is closed.

6. The gas valve unit of claim 5, wherein the valve sealing plate comprises an orifice arranged in a region of each valve seat, and wherein the shut-off body seated on the valve sealing plate seals the orifice when the open/close valve is closed.

7. The gas valve unit of claim 5, further comprising at least one permanent magnet producing a force for moving the shut-off body.

8. The gas valve unit of claim 5, wherein each open/close valve comprises a spring constructed to pretension the shut-off body toward the valve sealing plate.

9. The gas valve unit of claim 5, further comprising a pressure plate made from substantially rigid material arranged on a side of the valve sealing plate facing away from the shut-off body.

10. The gas valve unit of claim 9, wherein the substantially rigid material is a metal.

11. The gas valve unit of claim 9, wherein the pressure plate has apertures corresponding to orifices arranged in the valve sealing plate.

12. The gas valve unit of claim 11, further comprising a first gas distribution plate arranged between the pressure plate and the throttle plate, said first gas distribution plate having apertures corresponding to the apertures in the pressure plate and to the throttle openings in the throttle plate.

13. The gas valve unit of claim 12, wherein a open/close valve assigned to an aperture of the first gas distribution plate connects the aperture substantially unthrottled to a gas inlet of the gas valve unit when the open/close valve is open.

14. The gas valve unit of claim 12, further comprising a second gas distribution plate arranged on a side of the throttle plate facing away from the first gas distribution plate, wherein the second gas distribution plate comprises apertures corresponding to the throttle openings in the throttle plate.

15. The gas valve unit of claim 14, wherein precisely one aperture of the second gas distribution plate is connected to a gas outlet of the gas valve unit.

16. A gas valve unit for adjusting a volumetric gas flow supplied to a gas burner of a gas appliance, said gas valve unit comprising:

a plurality of open/close valves;

a valve body comprising a plurality of mutually parallel plates and at least two valve seats of the open/close valves;

at least two throttle points, with each of the at least two throttle points having at least one throttle opening, one of the parallel plates forming a valve sealing plate with the at least two valve seats of the open/close valves and another of the parallel plates forming a throttle plate with the throttle openings of the at least two throttle points;

a pressure plate made from substantially rigid material, the pressure plate having apertures corresponding to orifices arranged in the valve sealing plate; and a first gas distribution plate arranged between the pressure plate and the throttle plate, the first gas distribution plate having apertures corresponding to the apertures in the pressure plate and to the throttle openings in the throttle plate, wherein each open/close valve has a shut-off body seated on the valve sealing plate when the open/close valve is closed, the pressure plate is arranged on a side of the valve sealing plate facing away from the shut-off body, and at least some of the apertures in the first gas distribution plate connect two adjacent throttle openings of the throttle plate with one another.

17. The gas valve unit of claim 16, wherein the throttle openings are fixed open.

18. A gas valve unit for adjusting a volumetric gas flow supplied to a gas burner of a gas appliance, said gas valve unit comprising:

a plurality of open/close valves;

a valve body comprising a plurality of mutually parallel plates and at least two valve seats of the open/close valves;

at least two throttle points, with each of the at least two throttle points having at least one throttle opening, one of the parallel plates forming a valve sealing plate with the at least two valve seats of the open/close valves and another of the parallel plates forming a throttle plate with the throttle openings of the at least two throttle points;

a pressure plate made from substantially rigid material, the pressure plate having apertures corresponding to orifices arranged in the valve sealing plate;

a first gas distribution plate arranged between the pressure plate and the throttle plate, the first gas distribution plate having apertures corresponding to the apertures in the pressure plate and to the throttle openings in the throttle plate; and a second gas distribution plate arranged on a side of the throttle plate facing away from the first gas distribution plate, wherein the second gas distribution plate comprises apertures corresponding to the throttle openings in the throttle plate, wherein each open/close valve has a shut-off body seated on the valve sealing plate when the open/close valve is closed, the pressure plate is arranged on a side of the valve sealing plate facing away from the shut-off body, and at least some of the apertures in the second gas distribution plate connect two adjacent throttle openings of the throttle plate with one another.

19. The gas valve unit of claim 18, wherein adjacent throttle openings of the throttle plate that are connected by the apertures in the second gas distribution plate are throttle openings that are not connected by the first gas distribution plate.

20. The gas valve unit of claim 18, wherein the throttle openings are fixed open.

* * * * *